US007094366B2

(12) United States Patent
Hübner et al.

(10) Patent No.: US 7,094,366 B2
(45) Date of Patent: Aug. 22, 2006

(54) RESIN-BONDED GRAPHITE MATERIAL, METHOD FOR THE PRODUCTION OF A RESIN BONDED GRAPHITE MATERIAL AND USE THEREOF

(75) Inventors: Bettina Hübner, Münzenberg (DE); Rainer Sperling, Biebertal (DE); Klaus-Georg Tontsch, Giessen (DE)

(73) Assignee: Schunk Kohlenstofftechnik GmbH, Heuchelheim (DE)

( * ) Notice: Subject to any disclaimer, the term of this patent is extended or adjusted under 35 U.S.C. 154(b) by 26 days.

(21) Appl. No.: 10/495,119

(22) PCT Filed: Nov. 19, 2002

(86) PCT No.: PCT/EP02/12953

§ 371 (c)(1),
(2), (4) Date: May 19, 2004

(87) PCT Pub. No.: WO03/044808

PCT Pub. Date: May 30, 2003

(65) Prior Publication Data

US 2004/0260004 A1 Dec. 23, 2004

(30) Foreign Application Priority Data

Nov. 19, 2001 (DE) ..... 101 56 320

(51) Int. Cl.
*H01B 1/24* (2006.01)
*H01R 4/00* (2006.01)

(52) U.S. Cl. ..... 252/511; 524/495; 310/253; 313/311; 313/326

(58) Field of Classification Search ..... 252/502, 252/510, 511; 524/495, 496; 310/253; 313/311, 313/326
See application file for complete search history.

(56) References Cited

U.S. PATENT DOCUMENTS

| | | | | |
|---|---|---|---|---|
| 4,094,897 | A | 6/1978 | Nagasawa et al. | |
| 4,351,745 | A | 9/1982 | Stinger | |
| 5,078,936 | A | 1/1992 | Parish et al. | |
| 6,268,679 | B1 | 7/2001 | Reynvaan et al. | |
| 6,632,569 | B1 * | 10/2003 | Kameda et al. | 429/231.8 |
| 2004/0048162 | A1 * | 3/2004 | Barsukov et al. | 429/232 |

FOREIGN PATENT DOCUMENTS

| | | |
|---|---|---|
| DE | 2101982 | 10/1974 |
| DE | 3935140 | 4/1991 |
| DE | 19754411 | 6/1999 |
| EP | 1074997 | 2/2001 |

* cited by examiner

*Primary Examiner*—Mark Kopec
(74) *Attorney, Agent, or Firm*—Dennison, Schultz & MacDonald

(57) ABSTRACT

A resin bonded graphite material which is especially suitable for use as an electric contact, and a method for the production of this resin bonded graphite material. According to the invention, the resin-bonded graphite material if formed from a mixture of carbon black containing electro-graphite with a unburned graphite content of $R_G$ wherein $R_G \geqq 30$ percent by weight, electro-graphite free of carbon black as well as binding agents. The material has a specific electrical resistance $W_{spec}$ wherein $W_{spec} \geqq 3500$ μΩm, and use of the resin bonded graphite material as an electrical contact makes possible substantial exclusion of radio interference.

20 Claims, 1 Drawing Sheet

Figure 1:
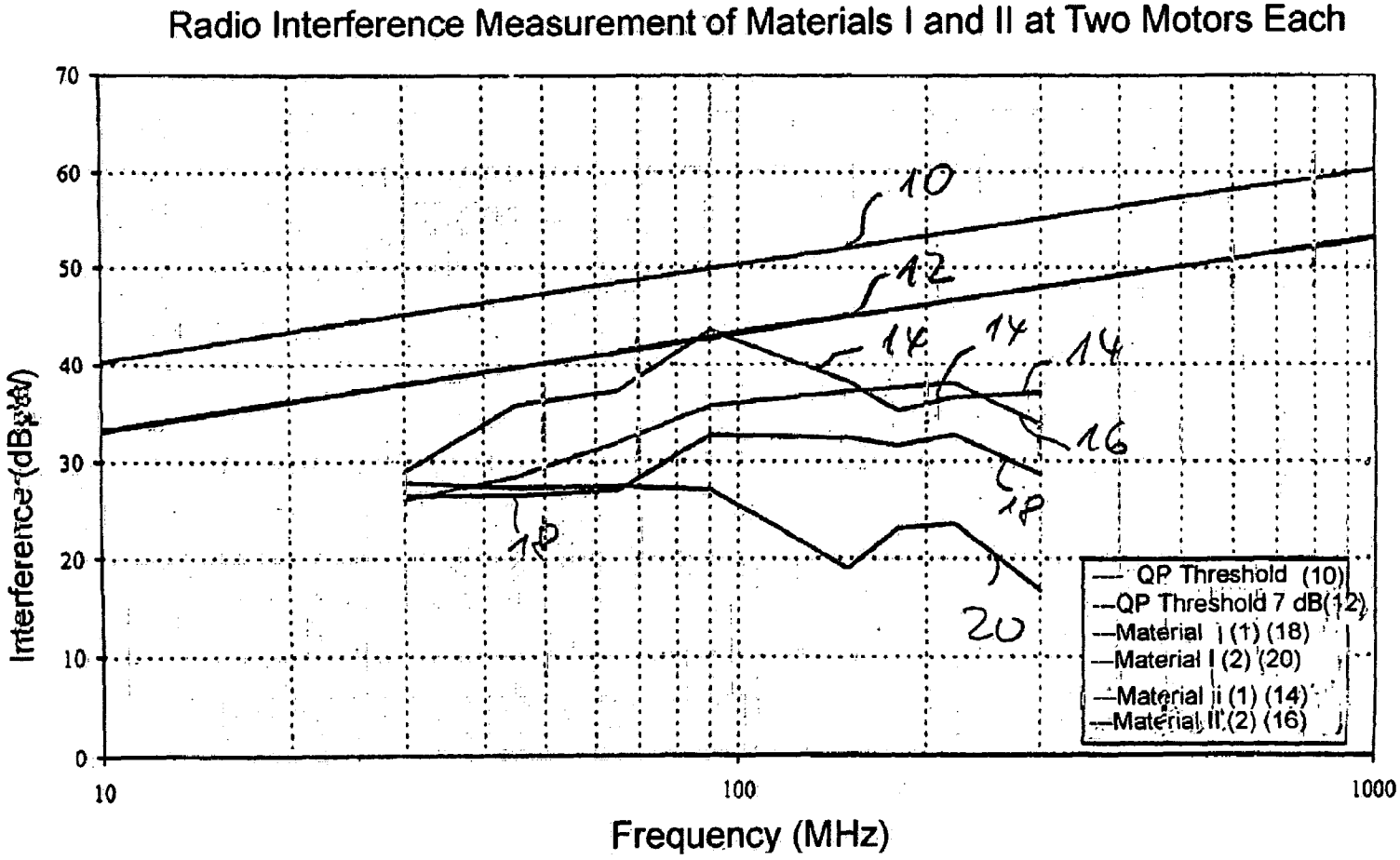

RESIN-BONDED GRAPHITE MATERIAL, METHOD FOR THE PRODUCTION OF A RESIN BONDED GRAPHITE MATERIAL AND USE THEREOF

This application is a filing under 35 USC 371 of PCT/EP02/12953 filed Nov. 19, 2002.

The invention refers to a resin-bonded graphite material, designated in particular for an electrical contact. In addition, the invention refers to a process for the manufacture of a resin-bonded graphite material, in particular for an electrical contact material. Finally, the invention refers to the use of a resin-bonded graphite material.

Resin-bonded graphite materials, carbon graphite materials, electro-graphite and graphite with metal additives such as copper and silver are used for carbon brushes, in particular small carbon brushes, just to name a few examples. The carbon graphite materials in particular are used with universal motors for household appliances as they distinguish themselves through their versatile usage for special trouble-shooting purposes. There is also good commutation, low radio interference, longevity and utilization options with high mechanical and electrical loads. Short circuit currents can be limited and the inner resistance of sources of interference can be increased through the use of the highest-impedance carbon brush material possible. Appropriate carbon graphite materials for this have a specific electrical resistance of up to 2400 μΩm (see "Data Sheet Schunk Kohlenstofftechnik GmbH, Carbon Brushes, Materials Physical Values, L-Materials: Carbon Graphite 01-13/14-99").

Regardless of the high-impedance carbon brush material that has been used up to now, it is also necessary to impregnate the carbon brushes in order to lower radio interference during the useful life of the carbon brush, in addition to the improved operation. Suppressors such as throttles or coils continue to be integrated.

The present invention is based on the problem of further developing a resin-bonded graphite material of the above-mentioned type such that radio interferences are excluded or nearly excluded during its use as an electrical contact without requiring further measures in principal such as impregnation.

According to the invention the problem is essentially solved with a resin-bonded graphite material in that the resin bonded graphite material consists of a hardened mixture of carbon black electro-graphite with a carbon black content of $R_G$ with $R_G \geqq 30$ percent by weight, a carbon black free of electro-graphite as well as binding agents, and has a specific electrical resistance $W_{spec}$ whereby $W_{spec} \geqq 3500$ μΩm. At least one additive such as a solid lubricant in form of, for example $MoS_2$ and/or $WS_2$ and/or an abrasive additive such as SiC and/or $Al_2O_3$ can be added to the mixture.

The carbon black free electro-graphite could especially be a carbon black free electro-graphite recycling material. Cartridge graphite, for example, could be used as the carbon black containing electro-graphite.

Independent of this, each source product should be a carbon black free or a carbon black containing raw material that is combined with binding agents and then ignited, graphitized, and ground up.

It is also provided that the carbon black containing electro-graphite has a specific electrical resistance $W_{spec}$ with >3500 μΩm ≧ 40 μΩm.

Apart from this the electro-graphite source substances should be isotropic, meaning that they have a specific electrical resistance that is direction independent.

The carbon black containing electro-graphite as well as the carbon black free electro-graphite should have a kernel size $d_{50}$ of 20 μm $\leqq d_{50} \leqq$ 40 μm. The figure $d_{50}$ in this means that 50% of the ground raw material falls through a sieve of the predetermined mesh size.

A synthetic powder resin such as a synthetic plastic, in particular Duroplast, is used as the binding agent. Preferably the binding agent is a powdered resin dissolved in a solvent or a solvent free liquid resin.

In addition the binding agent in the form of a liquid resin and/or of a powdered resin dissolved in a solvent should have a glass conversion temperature $T_0$ of 50° $\leqq T_0 \leqq$ 250° C. Another characteristic value of these resins is their viscosity V at room temperature wherein 10 cP $\leqq$ V $\leqq$ 6000 cP.

The mixture itself should have 15–75 parts by weight of the carbon black containing electro-graphite, 15–75 parts by weight of carbon black free electro-graphite, 0–10 parts by weight solid lubricants, 0–1 weight proportion of an abrasive additive, wherein 15–35 parts by weight bonding agent is added to the solid materials.

It should be noted that the noted parts by weight of the raw materials, i.e. of the carbon black free and the carbon black containing electro-graphite and—if applicable—the additional additives total 100 parts by weight to which the parts by weight of the binding agent of 15–35 are added, which are in reference to the 100 parts by weight of the raw materials.

Based on the mixture according to the invention consisting of carbon black containing electro-graphite, unburned fine-grained carbon containing electro-graphite, in particular electro-graphite recycling material, and liquid binding agents, the result is a resin-bonded graphite material with a specific electrical resistance $W_{spec}$>3500 μΩm, especially up to 10,000 μΩm or higher. Thus, one can speak almost of an insulator without any negative influence on electrical conductivity. Because of that there are advantages, in particular concerning radio interference, so that expensive suppressors such as throttles or coils can be avoided. It is also unnecessary to impregnate the material, which is necessary at least according to the state of the art. This material is used with a small engine power (<400 watts) and preferably 220–250 V voltage, in order to keep the electrical current small. In an operation of this engine power range no high temperatures occur at the carbon brush as they do with traditional materials. In addition, the useful life and the wear of the carbon brush is comparable with traditional materials.

A process for the manufacture of a resin-bonded graphite material, in particular for use as an electrical contact material, is essentially described with the following process steps:

Mixing of carbon black containing electro-graphite with a carbon black content $R_G$ wherein $R_G$>30 percent by weight, burned carbon free, small kernel electro-graphite with a specific resistance value $W_{spec}$ of 8 μΩm $\leqq W_{spec} \leqq$ 30 μΩm and a liquid binding agent at a temperature $T_1$, Grinding of the mixture, Pressurizing the ground-up mixture to a pellet and subsequent hardening.

In particular, the carbon black containing electro graphite, the carbon black free small kernel electro-graphite and the liquid binding agent such as liquid resin are mixed at room temperature. This mixture is then ground to a kernel size $d_{50}$ wherein 50 μm $\leqq d_{50} \leqq$ 150 μm. The ground mixture is then exposed to a pressure of between 1000 and 2000 kp/cm$^2$. The pellet can than be hardened over a period of t of 10 hours $\leqq$ 1 $\leqq$ 20 hours with a final temperature T at 180° C. $\leqq$ T $\leqq$ 250° C.

A high specific electrical resistance of the resin-bonded graphite material according to the invention is achieved when 15–75 parts by weight of carbon black containing electro-graphite, 15–75 parts by weight of carbon black free small kernel electro-graphite and 15–35 parts by weight of binding agents are mixed, wherein preferably 0–10 parts by weight of solid lubricant and/or 0–1 weight proportion of abrasive additive are added to the mixture.

Carbon black free electro-graphite recycling material can be used as the carbon black free electro-graphite and/or cartridge graphite can be used as the carbon black containing electro-graphite. Powder resin dissolved in a solvent or solvent-free liquid resin can be used as the binding agent, wherein as the binding agent one that is based upon a synthetic material such as epoxy resin or phenolic resin should be used. If a liquid binding agent is used, it should have a glass conversion temperature $T_G$ with 50° Celsius$\leqq T_G \leqq$250° C. and/or at room temperature a viscosity V of 10 cP$\leqq$V$\leqq$6000 cP.

The invention especially distinguishes itself by the fact that the resin-bonded graphite material is used as material for a carbon brush or an abrasive ring.

Additional details, advantages and characteristics of the invention result not only from the claims and the characteristics depicted there—for themselves and/or in combination—but also from at least the following description of examples.

EXAMPLE 1

Fifty parts by weight of carbon black containing electro-graphite with a carbon black content of 50 percent by weight, a specific electrical resistance $W_{spec}$ of approximately 100 μΩm and a kernel size $d_{50}$ of 30 μm, and 50 parts by weight of burned carbon free small kernel electro-graphite recycling material with a specific electrical resistance $W_{spec}$ of 20 μΩm and a kernel size $d_{50}$ of 30 μm were mixed with 25 parts by weight of a powder resin dissolved in a solvent in the form of an epoxy resin, in a sigma kneader at room temperature for the production of a carbon brush designated for small electrical engines. The finished mixture is then ground to a kernel size $d_{50}$ of 90 μm and pressurized with a specific pressure of 1500 kp/cm$^2$. The pellets were then subjected to a 15 hour hardening cycle with a final temperate of 200° C. The pellets had a specific electrical resistance $W_{spec}$ of 8000 μΩm. The carbon brushes produced from these pellets were then compared in comparison measurements with carbon brushes made from traditional resin-bonded carbon graphite materials with a specific electrical resistance $W_{spec}$ of 600 μΩm. In this, radio interference measurements were performed at two electrical motors. The results can be seen in FIG. 1.

The graphic designated with the reference number 10 in the only drawing corresponds to the threshold of the radio interference gauge, whereas the straight line with the reference number 12 is the threshold reduced by 7 dB.

The curves 14, 16 were measured at two motors that were equipped with carbon brushes made from the traditional carbon brush material. The measurement curves 18, 20 are the results of the same motors, equipped, however, with the carbon brushes made from the material according to the invention, which had a specific electrical resistance of 8000 μΩm. A significant reduction in radio interference is apparent with the material according to the invention.

EXAMPLE 2

Forty parts by weight of carbon black containing electro-graphite with a carbon black content of 50 percent by weight, a specific electrical resistance $W_{spec}$ of approximately 100 μΩm and a kernel size $d_{50}$ of 30 μm, and 60 parts by weight of burned carbon free small kernel electro-graphite recycling material with a specific electrical resistance $W_{spec}$ of 20 μΩm and a kernel size $d_{50}$ of 30 μm were mixed with 25 parts by weight of a powder resin dissolved in a solvent in the form of an epoxy resin, in a sigma kneader at room temperature, for the production of a carbon brush designated for small electrical engines. The finished mixture was then ground to a kernel size $d_{50}$ of 90 μm and pressurized with a specific pressure of 1500 kp/cm$^2$. The pellets were then subjected to a 15 hour hardening cycle with a final temperate of 200° C. The pellets had a specific electrical resistance $W_{spec}$ of 5000 μΩm. The carbon brushes produced from these pellets were then compared in comparison measurements with traditional resin-bonded carbon graphite material with a specific electrical resistance $W_{spec}$ of 600 μΩm. Radio interference measurements according to Example 1 showed a significant reduction in radio interference in comparison with the traditional brushes.

What is claimed is:

1. An electrical contact in the form of a brush or a collector ring comprising a resin-bonded graphite material, the resin-bonded graphite material comprising a mixture of carbon black containing electro-graphite with a unburned graphite content of $R_G$, wherein $R_G \geqq 30$ percent by weight, electrographite free of carbon black, and binding agent, the resin bonded graphite material having a specific electrical resistance 3500 μΩm$\leqq W_{spec} \leqq$15,000 μΩm.

2. The electrical contact according to claim 1, wherein the binding agent has a viscosity 10 cP$\leqq$V$\leqq$6000 cP at room temperature.

3. The electrical contact according to claim 1, wherein $W_{spec} \leqq$10,000 μΩm.

4. The electrical contact according to claim 1, wherein the mixture contains at least one additive selected from the group consisting $MoS_2$, $WS_2$ and an abrasive additive.

5. The electrical contact according to claim 4, wherein the abrasive additive is selected from the group consisting of SiC, $Al_2O_3$ and mixtures thereof.

6. The electrical contact according to claim 1, wherein the carbon black free electro-graphite is a carbon black free electro-graphite recycled material.

7. The electrical contact according to claim 4, wherein the carbon black containing electro-graphite, the carbon black free electrographite and the additive form a total of 100 parts by weight, to which the binding agent in a proportion of 15 to 35 parts by weight is added.

8. The electrical contact according to claim 1, wherein carbon black containing electro-graphite is cartridge graphite.

9. The electrical contact according to claim 1, wherein the carbon black containing electro-graphite has a specific resistance 3500 μΩm$\geqq W_{spec} \geqq$40 μΩm.

10. The electrical contact according to claim 1, wherein the carbon black free electro-graphite has a specific electrical resistance 8 μΩm$\leqq W_{spec} \leqq$30 μΩm.

11. The electrical contact according to claim 1, wherein the carbon black containing electrographite has a kernel size 20 μm$\leqq d_{50} \leqq$50 μm.

12. The electrical contact according to claim 1, wherein the carbon black free electrographite has a kernel size 20 μm $d_{50} \leqq 50$ μm.

13. The electrical contact according to claim 1, wherein at least one of the carbon black containing electro-graphite and the carbon black free electro-graphite is isotropic in reference to the specific electrical resistance.

14. The electrical contact according to claim 1, wherein the binding agent is a synthetic powder resin.

15. The electrical contact according to claim 14, wherein the binding agent is a Duroplast.

16. The electrical contact according to claim 1, wherein the binding agent is at least one resin selected from the group consisting of a synthetic epoxy powder resin and a phenolic resin.

17. The electrical contact according to claim 1, wherein the binding agent is at least one resin selected from the group consisting of a powder resin dissolved in a solvent and a solvent-free liquid resin.

18. The electrical contact according to claim 1, wherein the carbon black containing electrographite and the carbon black free electro-graphite form a total of 100 parts by weight, to which the binding agent in a proportion of 15 to 35 parts by weight is added.

19. The electrical contact according to claim 1, wherein the binding agent has a glass conversion temperature 50° C.$\leqq T_G \leqq$250° C.

20. The electrical contact according to claim 1, wherein the mixture comprises 15 to 75 parts by weight of the carbon black containing electro-graphite, 15 to 75 parts by weight of the carbon black free electro-graphite, 0 to 10parts by weight of a solid lubricant, 0 to 1 parts by weight of an abrasive additive, and 15 to 35 parts by weight of the binding agent.

* * * * *